US010203105B1

(12) United States Patent
Zhang et al.

(10) Patent No.: US 10,203,105 B1
(45) Date of Patent: Feb. 12, 2019

(54) OUTDOOR PROJECTOR

(71) Applicant: Gemmy Industries Corporation, Coppell, TX (US)

(72) Inventors: Cheng Chun Zhang, Shenzhen (CN); Lio Yenwei Chang, Coppell, TX (US)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 15/912,914

(22) Filed: Mar. 6, 2018

(51) Int. Cl.

| | |
|---|---|
| ***F21V 31/00*** | (2006.01) |
| ***F21V 5/00*** | (2018.01) |
| ***F21V 14/06*** | (2006.01) |
| ***F21V 5/04*** | (2006.01) |
| *F21W 121/00* | (2006.01) |

(52) U.S. Cl.
CPC ..... *F21V 31/005* (2013.01); *F21V 5/008* (2013.01); *F21V 5/045* (2013.01); *F21V 14/06* (2013.01); *F21W 2121/00* (2013.01)

(58) Field of Classification Search
CPC ..... F21V 31/005; F21V 5/045; F21V 14/06; F21V 5/008; F21W 2121/00
See application file for complete search history.

(56) References Cited

U.S. PATENT DOCUMENTS

| | | | | |
|---|---|---|---|---|
| 10,077,889 | B1 * | 9/2018 | Qin | F21V 14/06 |
| 2017/0191630 | A1 * | 7/2017 | Lentine | F21V 21/0824 |
| 2017/0219176 | A1 * | 8/2017 | Chang | F21S 10/007 |

* cited by examiner

*Primary Examiner* — Kevin Quarterman
(74) *Attorney, Agent, or Firm* — C. G. Mersereau; DeWitt, Mackall, Crounse & Moore, S.C.

(57) ABSTRACT

An outdoor projector has a casing, a projecting set, and a rotating set. The casing has a shell, a lens set, and a wire base. An operating space is formed in the shell. An opening is formed through a front end of the shell. A wire hole is formed through a rear end of the shell. The projecting set is located in the operating space of the casing and has a support frame, a main light unit, and an auxiliary light unit. The support frame is combined with the shell and is located in the operating space. The main light unit and the auxiliary light unit are combined with the support frame. The rotating set is located in the operating space and has an electric machine and a gear base. The electric machine is combined with the support frame. The gear base rotatably abuts the support frame.

17 Claims, 7 Drawing Sheets

OUTDOOR PROJECTOR

BACKGROUND OF THE INVENTION

1. Field of the Invention

The invention relates to a projector, and more particularly to an outdoor projector which is waterproof.

2. Description of Related Art

A conventional outdoor projector has functions of projecting and rotating. The conventional outdoor projector has a casing, a projecting set, and a rotating set. The casing has a lower shell, an upper shell, a cover, and a supporting element. The upper shell is combined with the lower shell. The cover is mounted on the upper shell. The supporting element is mounted at a bottom surface of the lower shell. The projecting set is located in the upper shell, and can emit light and project a pattern. The rotating set is located in the lower shell, and projects color clouds constantly rotating and floating. Therefore, the conventional outdoor projector can project a clear pattern with different color clouds surrounding the pattern. The cover can protect the conventional projector from being damaged by water.

However, the conventional outdoor projector is composed of the lower shell and the upper shell combined with each other, so the volume of the conventional outdoor projector is too big to carry around. The manufacturing cost of the lower shell and the upper shell is too high since the lower shell and the upper shell need respective materials. There is no waterproof element between the lower shell and the upper shell, and therefore, water may leak into the conventional outdoor projector.

To overcome the shortcomings of the conventional projector, the present invention provides an outdoor projector to mitigate or obviate the aforementioned problems.

SUMMARY OF THE INVENTION

The main objective of the present invention is to provide an outdoor projector that is waterproof.

The outdoor projector has a casing, a projecting set, and a rotating set. The casing has a shell, a lens set, and a wire base. An operating space is formed in the shell. An opening is formed through a front end of the shell. A wire hole is formed through a rear end of the shell. The projecting set is located in the operating space of the casing and has a support frame, a main light unit, and an auxiliary light unit. The support frame is combined with the shell and is located in the operating space. The main light unit and the auxiliary light unit are combined with the support frame. The rotating set is located in the operating space and has an electric machine and a gear base. The electric machine is combined with the support frame. The gear base rotatably abuts the support frame.

Other objects, advantages, and novel features of the invention will become more apparent from the following detailed description when taken in conjunction with the accompanying drawings.

DETAILED DESCRIPTION OF PREFERRED EMBODIMENT

Figure 1:
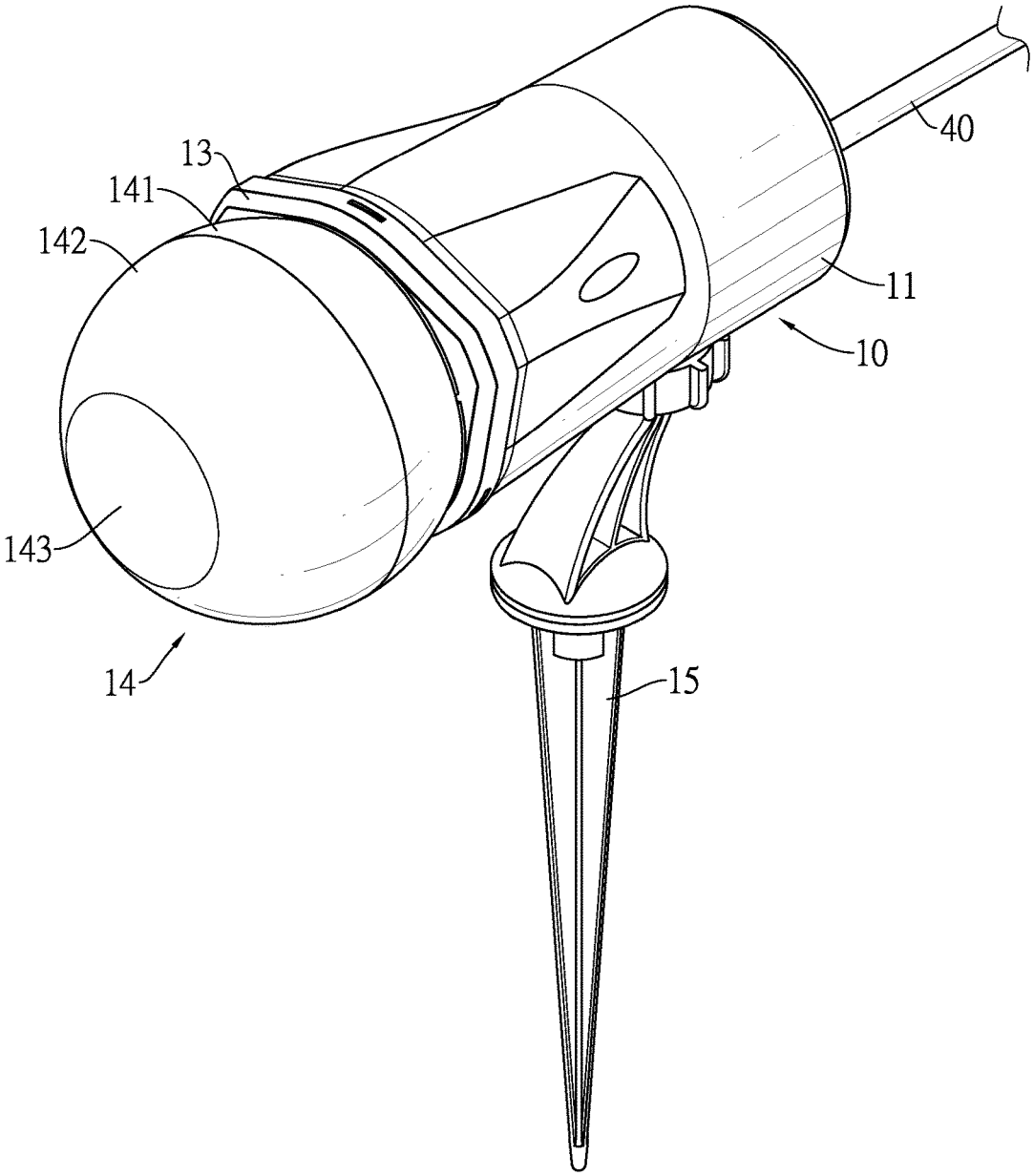
FIG. 1 is a perspective view of an outdoor projector in accordance with the present invention.
Figure 2:
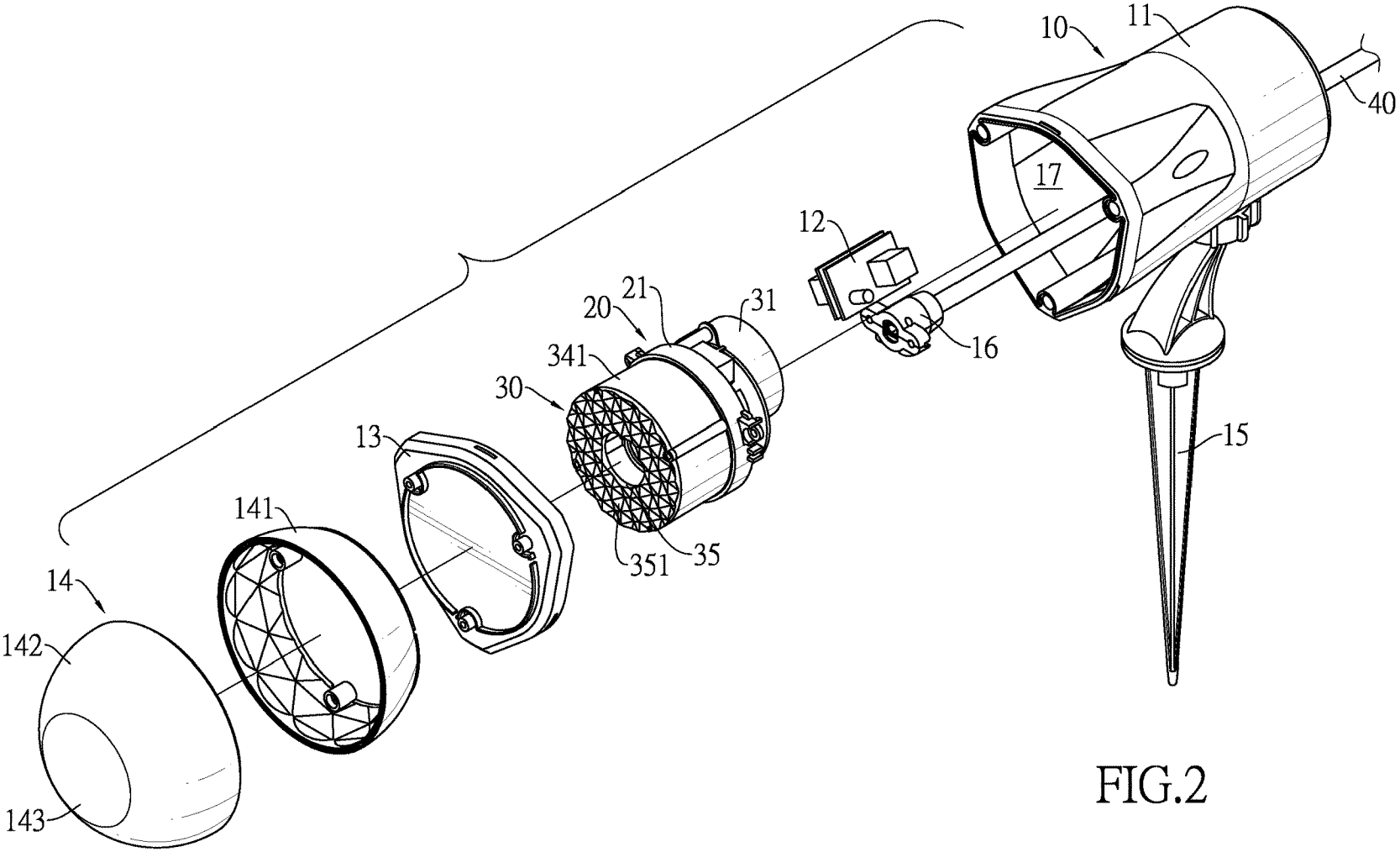
FIG. 2 is an exploded perspective view of the outdoor projector in FIG. 1.
Figure 3:
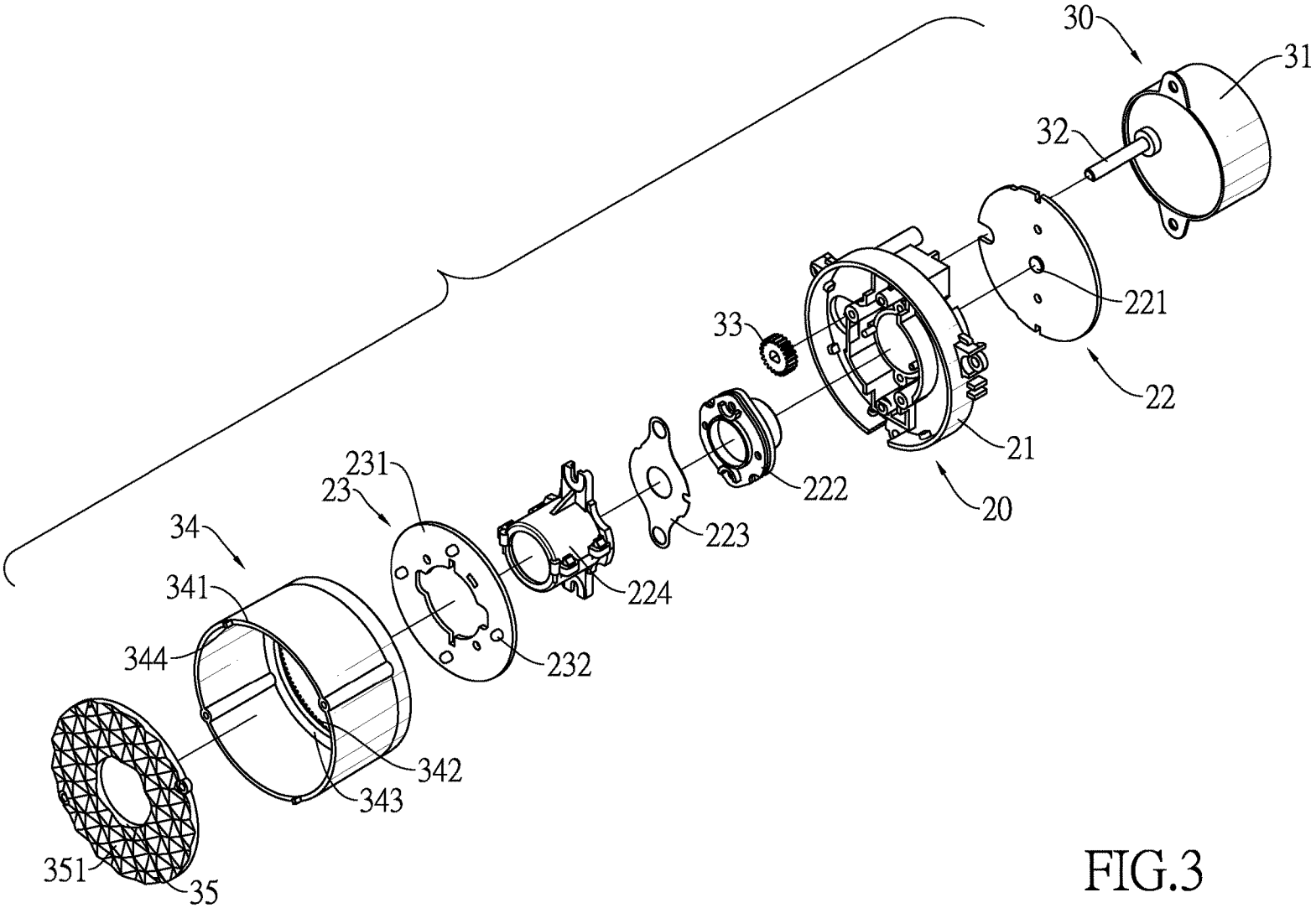
FIG. 3 is another exploded perspective view of the outdoor projector in FIG. 1.

With reference to FIGS. 1 to 3, an outdoor projector in accordance with the present invention comprises a casing 10, a projecting set 20, and a rotating set 30.

Figure 6:
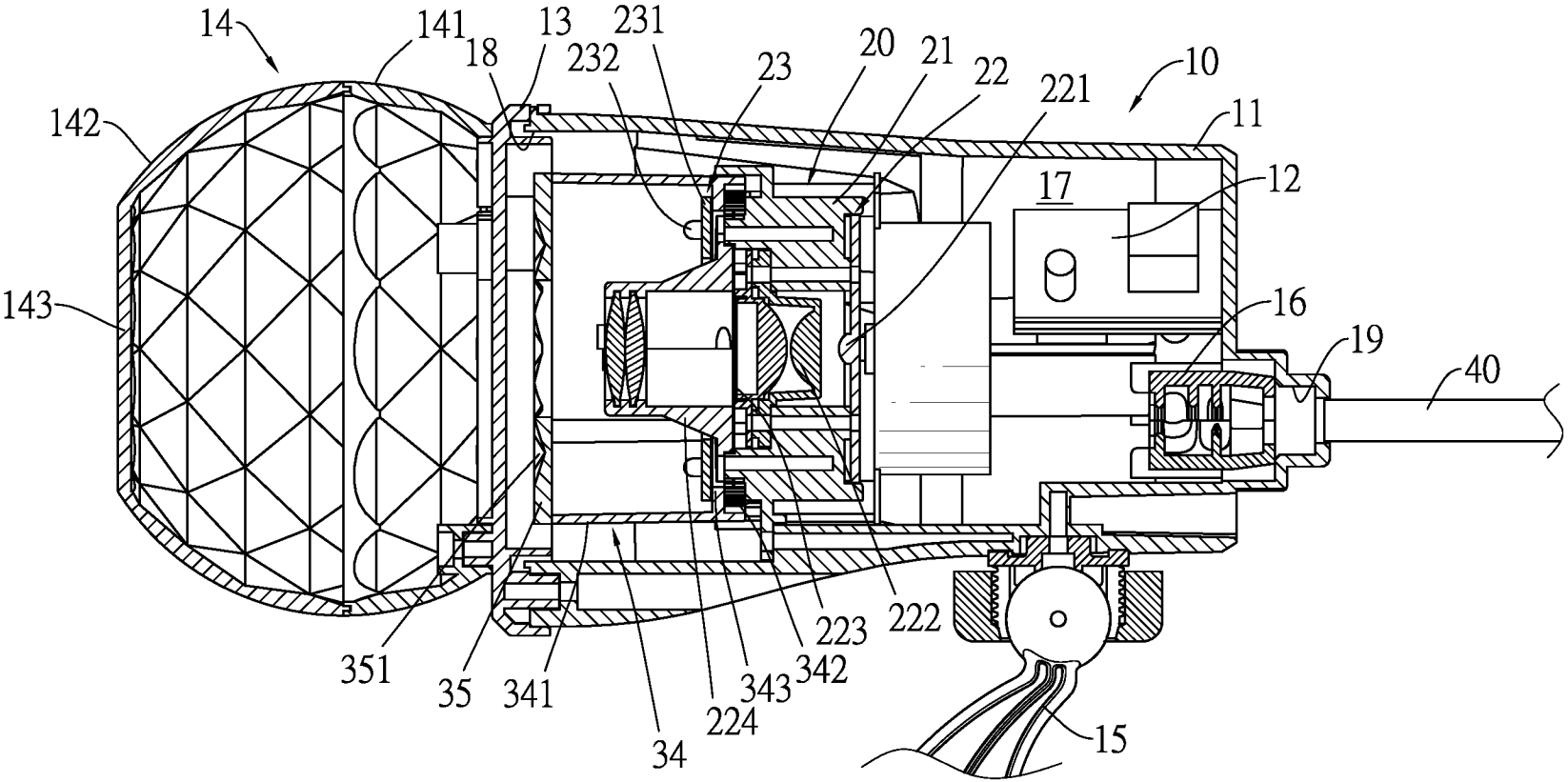
FIG. 6 is a side view in partial section of the outdoor projector in FIG. 1.

With reference to FIGS. 1, 2, and 6, the casing 10 has a shell 11, a power supply board 12, a cover 13, a lens set 14, a supporting element 15, and a wire base 16. An operating space 17 is formed in the shell 11. The shell 11 has a front end and a rear end, and an opening 18 is formed through the front end of the shell 11 and communicates with the operating space 17. The opening 18 has an annular edge. A wire hole 19 is formed through the rear end of the shell 11 and communicates with the operating space 17. The wire hole 19 has a circular edge. The power supply board 12 is located in the operating space 17. The cover 13 is combined with the shell 11 and abuts the annular edge of the opening 18. The lens set 14 is mounted on a front surface of the cover 13. The lens set 14 has a connecting lens 141 and a projecting lens 142. The connecting lens 141 is connected with the front surface of the cover 13. The projecting lens 142 is combined with the connecting lens 141, and a front surface of the projecting lens 142 is a plane 143. The connecting lens 141 and the projecting lens 142 are Fresnel lenses. The supporting element 15 is mounted on a bottom surface of the shell 11. The wire base 16 is located in the shell 11 and abuts the circular edge of the wire hole 19.

Figure 4:
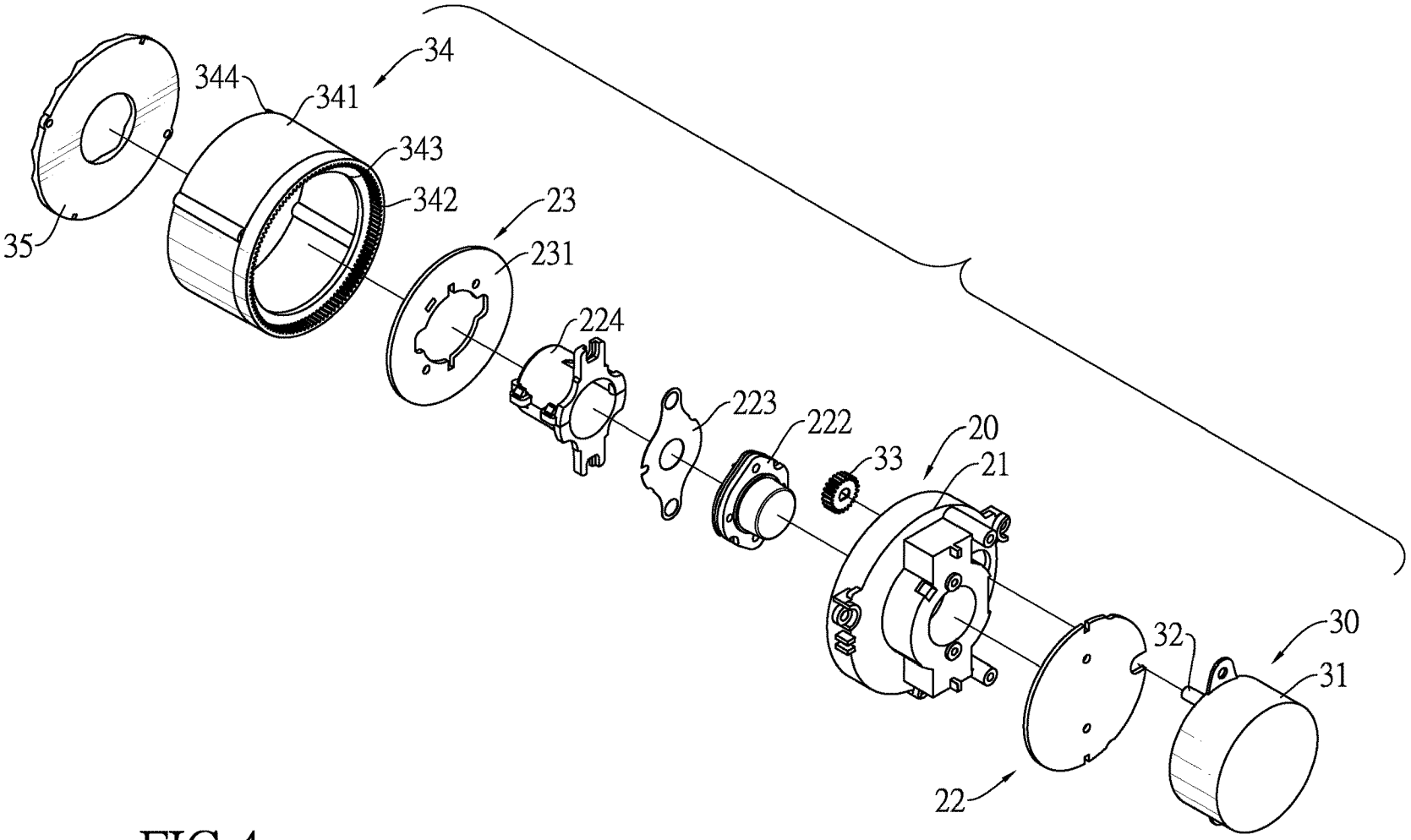
FIG. 4 is another exploded perspective view of the outdoor projector in FIG. 1.

With reference to FIGS. 2 to 4, the projecting set 20 is located in the operating space 17 of the casing 10. The projecting set 20 has a support frame 21, a main light unit 22, and an auxiliary light unit 23. The support frame 21 is combined with the shell 11 and is located in the operating space 17 of the casing 10. The main light unit 22 is combined with the support frame 21 and has a main light 221, at least one condensing lenses 222, a film strip 223, and at least one imaging lens 224. The main light 221 is mounted at a center of the support frame 21. The at least one condensing lenses 222 is combined with the support frame 21 and is located in front of the main light 221. The film strip 223 is combined with the support frame 21 and is located in front of the condensing lenses 222. The at least one imaging lens 224 is combined with the support frame 21 and is located in front of the film strip 223. The auxiliary light unit 23 is connected with the support frame 21, and the auxiliary light unit 23 is mounted around the main light unit 22. The auxiliary light unit 23 has an auxiliary light board 231 and multiple auxiliary lights 232. The auxiliary light board 231 is combined with the support frame 21. The multiple auxiliary lights 232 are disposed around the main light unit 22 and are mounted on the auxiliary light board 231.

Figure 7:
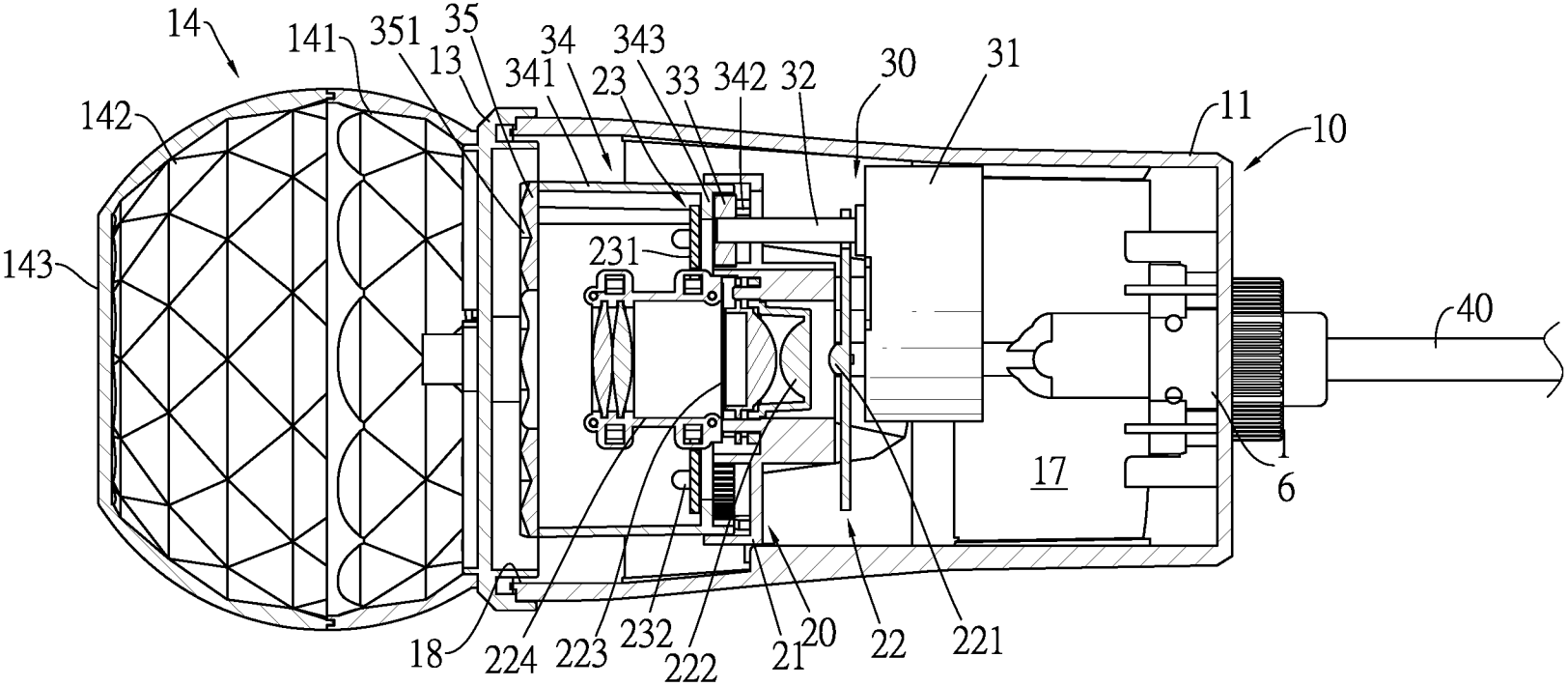
FIG. 7 is a top view in partial section of the outdoor projector in FIG. 1.

With reference to FIGS. 2, 4, and 7, the rotating set 30 is located in the operating space 17 of the casing 10. The rotating set 30 has an electric machine 31, a shaft 32, a gear 33, a gear base 34, and an assembling lens 35. The electric machine 31 is combined with the support frame 21 and is electrically connected with the power supply board 12. The shaft 32 has a first end and a second end. The first end of the shaft 32 is rotatably combined with the electric machine 31. The gear 33 is combined with the second end of the shaft 32. The gear base 34 rotatably abuts the support frame 21. The gear base 34 has a collar 341, a gear rack 342, a spacer rib 343, and two mounting portions 344. The collar 341 is rotatably combined with the support frame 21. The collar 341 has a surrounding surface. The gear rack 342 is mounted at the surrounding surface of the collar 341 and is engaged with the gear 33. The spacer rib 343 is mounted at the surrounding surface of the collar 341 and is adjacent to the gear rack 342. The spacer rib 343 is located between the auxiliary light unit 23 and the main light unit 22. The two mounting portions 344 are mounted on a front surface of the collar 341, and the two mounting portions 344 are respectively located adjacent to two diametrically opposite ends of the collar 341. The assembling lens 35 is combined with the gear base 34 and is located at a front end of the gear base 34. The assembling lens 35 has multiple corrugations 351. The assembling lens 35 is combined with the two mounting portions 344. Furthermore, the gear base 34 and the assembling lens 35 are hollow.

Figure 5:
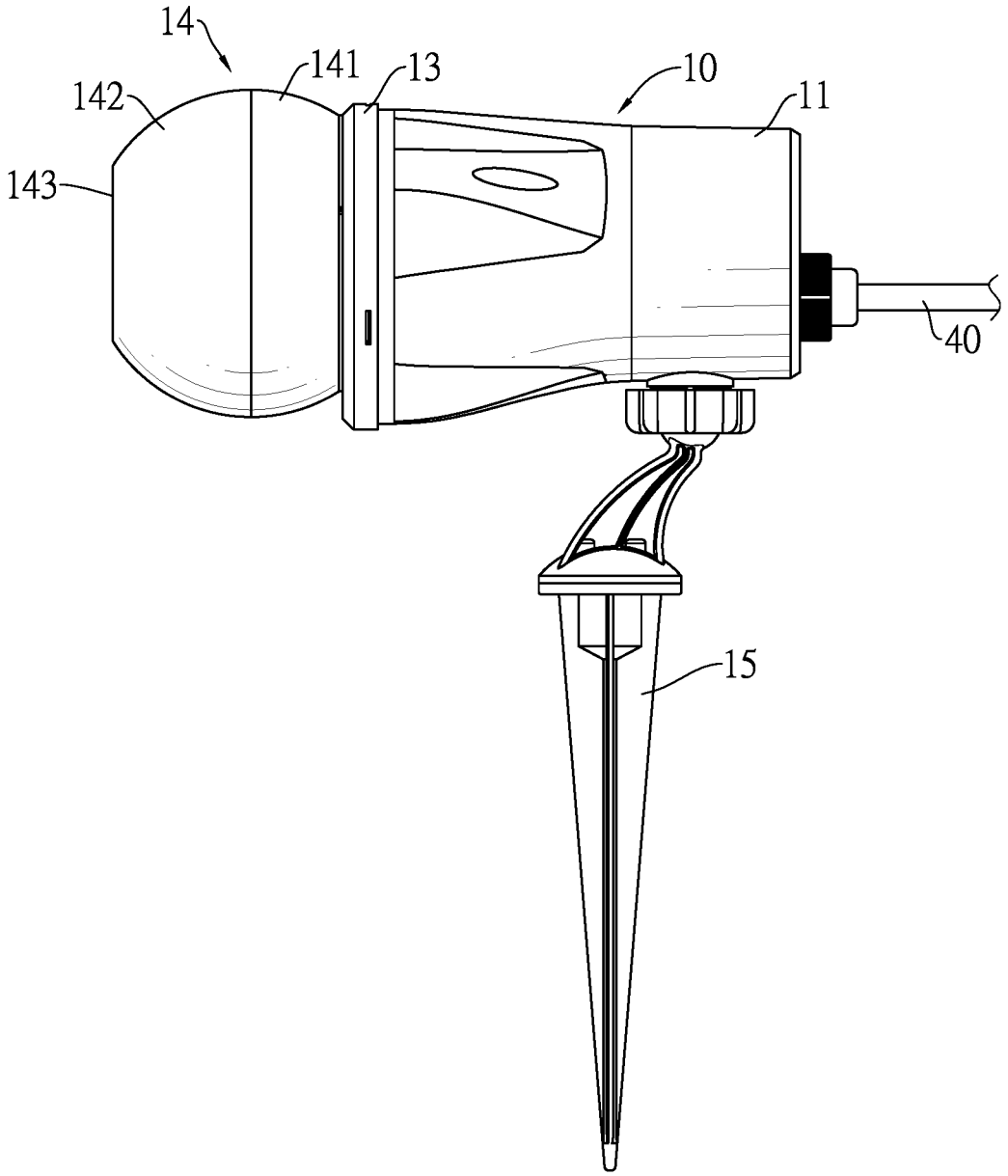
FIG. 5 is a side view of the outdoor projector in FIG. 1.

With reference to FIGS. 5 to 7, when the outdoor projector in accordance with the present invention is in use, a wire 40 is inserted into the wire base 16 and is connected with the power supply board 12 via the wire hole 19. The wire 40 may be fixed to the wire base 16, and the wire 40 can supply electricity to the power supply board 12. The power supply board 12 may switch Alternate Current (AC) to Direct Current (DC), and the DC would be supplied to the main light unit 22 and the auxiliary light unit 23 of the projecting set 20 and the electric machine 31 of the rotating set 30. The main light 221 emits light, the emitted light passes through the at least one condensing lenses 222. The light emitted from the main light 221 would focus and pass through the film strip 223, and then pass through the frame 224. The pattern on the film strip 223 would be projected into the environment. Because the front surface of the projecting lens 142 of the lens set 14 is a plane 143, the light emitted from the main light 221 to the film strip 223 would not be twisted. The auxiliary light 232 of the auxiliary light unit 23 would also emit light.

The electric machine 31 would drive the shaft 32 to rotate, and the gear 33 would be rotated with the shaft 32. Because the gear 33 is engaged with the gear rack 342 of the gear base 34, the gear base 34 would be driven by the gear 33 and rotate relative to the support frame 21. The mounting portion 344 and the assembling lens 35 would be rotated with the collar 341 of the gear base 34, and the corrugations 351 of the assembling lens 35 would rotate with the assembling lens 35. The light emitted from the auxiliary light unit 23 would pass through the corrugations 351 of the assembling lens 35, and then the light would pass through the connecting lens 141 and the projecting lens 142 of the lens set 14. The light emitted from the auxiliary light unit 23 may project the corrugations 351 of the assembling lens 35, and form multiple colors and floating cloud patterns. The floating cloud patterns may cooperate with a pattern projected by the film strip 223, thereby displaying the clear pattern surrounded by dynamic colorful clouds floating around, offering an entertaining and enriching visual experience.

The cover 13 is combined with the shell 11 and abuts the annular edge of the opening 18. The wire base 16 is located in the shell 11 and abuts the circular edge of the wire hole 19. Therefore, the casing 10 is excellent in the waterproof function. Water cannot permeate into the shell 11 when the casing 10 accidentally drops into water or is soaked in water, that is, the casing 10 can protect the projecting set 20 and the rotating set 30 well. Furthermore, the color of the main light unit 22 and the auxiliary light unit 23 are changeable, the pattern or colorful clouds can mix to form different dynamic backgrounds.

When the outdoor projector in accordance with the present invention is in use, the projecting set 20 and the rotating set 30 are located in the operating space 17, so the occupied space of the shell 11 can be reduced. Furthermore, the manufacturing cost and material usage of the shell 11 are also reduced. The cover 13 also seals the opening 18, and the wire base 16 seals the wire hole 19 to enhance the waterproof function.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An outdoor projector comprising:

a casing having
- a shell having
  - an operating space formed in the shell;
  - an opening formed through a front end of the shell and communicating with the operating space; and
  - a wire hole formed through a rear end of the shell and communicating with the operating space;
- a power supply board located in the operating space;
- a cover combined with the shell and sealing the opening;
- a lens set mounted on the cover;
- a supporting element mounted on a bottom surface of the shell; and
- a wire base located in the shell and sealing the wire hole;

a projecting set located in the operating space of the casing and having
- a support frame combined with the shell and located in the operating space of the casing;
- a main light unit combined with the support frame and having
  - a main light mounted at a center of the support frame;
  - at least one condensing lenses combined with the support frame and located in front of the main light;
  - a film strip combined with the support frame and located in front of the main light lens; and
  - at least one imaging lens combined with the support frame and located in front of the film strip; and
- an auxiliary light unit connected with the support frame and mounted around the main light unit;

a rotating set located in the operating space of the casing and having
- an electric machine combined with the support frame and electrically connected with the power supply board;
- a shaft having a first end rotatably combined with the electric machine and a second end;
- a gear combined with the second end of the shaft;
- a gear base rotatably abutting the support frame, the gear base being hollow; and an assembling lens combined with the gear base and located at a front end of the gear base, and the assembling lens being hollow.

2. The outdoor projector as claimed in claim 1, wherein the auxiliary light unit has an auxiliary light board and multiple auxiliary lights, the auxiliary light board is combined with the support frame, and the multiple auxiliary lights are disposed around the main light unit and are mounted on the auxiliary light board.

3. The outdoor projector as claimed in claim 1, wherein the gear base has a collar rotatably combined with the support frame and having a surrounding surface;

a gear rack mounted at the surrounding surface of the collar and engaged with the gear;

a spacer rib mounted at the surrounding surface of the collar and being adjacent to the gear rack, and located between the auxiliary light unit and the main light unit; and two mounting portions mounted on a front surface of the collar, and the two mounting portions respectively located adjacent to two diametrically opposite ends of the collar.

4. The outdoor projector as claimed in claim 2, wherein the gear base has a collar rotatably combined with the support frame and having a surrounding surface;

a gear rack mounted at the surrounding surface of the collar and engaged with the gear;

a spacer rib mounted at the surrounding surface of the collar and being adjacent to the gear rack, and located between the auxiliary light unit and the main light unit; and two mounting portions mounted on a front surface of the collar, and the two mounting portions respectively located adjacent to two diametrically opposite ends of the collar.

5. The outdoor projector as claimed in claim 1, wherein the lens set has a connecting lens and a projecting lens, the connecting lens is connected with a front surface of the cover, the projecting lens is combined with the connecting lens, a front surface of the projecting lens is a plane, and the connecting lens and the projecting lens are Fresnel lenses.

6. The outdoor projector as claimed in claim 2, wherein the lens set has a connecting lens and a projecting lens, the connecting lens is connected with a front surface of the cover, the projecting lens is combined with the connecting lens, a front surface of the projecting lens is a plane, and the connecting lens and the projecting lens are Fresnel lenses.

7. The outdoor projector as claimed in claim 3, wherein the lens set has a connecting lens and a projecting lens, the connecting lens is connected with a front surface of the cover, the projecting lens is combined with the connecting lens, a front surface of the projecting lens is a plane, the connecting lens and the projecting lens are Fresnel lenses.

8. The outdoor projector as claimed in claim 4, wherein the lens set has a connecting lens and a projecting lens, the connecting lens is connected with a front surface of the cover, the projecting lens is combined with the connecting lens, a front surface of the projecting lens is a plane, and the connecting lens and the projecting lens are Fresnel lenses.

9. The outdoor projector as claimed in claim 1, wherein the assembling lens has multiple corrugations.

10. The outdoor projector as claimed in claim 2, wherein the assembling lens has multiple corrugations.

11. The outdoor projector as claimed in claim 3, wherein the assembling lens has multiple corrugations.

12. The outdoor projector as claimed in claim 4, wherein the assembling lens has multiple corrugations.

13. The outdoor projector as claimed in claim 5, wherein the assembling lens has multiple corrugations.

14. The outdoor projector as claimed in claim 6, wherein the assembling lens has multiple corrugations.

15. The outdoor projector as claimed in claim 7, wherein the assembling lens has multiple corrugations.

16. The outdoor projector as claimed in claim 8, wherein the assembling lens has multiple corrugations.

17. The outdoor projector as claimed in claim 9, wherein the assembling lens has multiple corrugations.

* * * * *